US011540599B1

(12) United States Patent
Yokoyama et al.

(10) Patent No.: US 11,540,599 B1
(45) Date of Patent: Jan. 3, 2023

(54) WATCH BAND WITH ADJUSTABLE FIT

(71) Applicant: Apple Inc., Cupertino, CA (US)

(72) Inventors: Yoshihiko Yokoyama, Katta-gun (JP); Osamu Yabe, Mountain View, CA (US); Eiryo Shiraishi, Tokyo-to (JP); Naoto Matsuyuki, Kasugai (JP)

(73) Assignee: APPLE INC., Cupertino, CA (US)

( * ) Notice: Subject to any disclaimer, the term of this patent is extended or adjusted under 35 U.S.C. 154(b) by 401 days.

(21) Appl. No.: 16/830,088

(22) Filed: Mar. 25, 2020

Related U.S. Application Data

(60) Provisional application No. 62/906,650, filed on Sep. 26, 2019.

(51) Int. Cl.
*A44C 5/00* (2006.01)

(52) U.S. Cl.
CPC ..... *A44C 5/0053* (2013.01)

(58) Field of Classification Search
None
See application file for complete search history.

(56) References Cited

U.S. PATENT DOCUMENTS

| | | | | |
|---|---|---|---|---|
| 9,609,921 | B1 | 4/2017 | Feinstein | |
| 2016/0255944 | A1* | 9/2016 | Baranski | A44C 5/2071 |
| 2020/0375270 | A1* | 12/2020 | Holschuh | B32B 5/08 |

FOREIGN PATENT DOCUMENTS

| | | | | |
|---|---|---|---|---|
| CN | 102845841 | A * | 1/2013 | A61F 13/08 |

* cited by examiner

*Primary Examiner* — Kristy A Haupt
(74) *Attorney, Agent, or Firm* — Bakerhostetler

(57) ABSTRACT

Watch bands can be provided with an ability to dynamically adjust the fit of a watch against a wrist of a user. One or more of a variety of tensioning elements can be provided with a shape memory polymer that responds to a stimulus to adjust a fit of the band. Such stimulus can be from user or actively applied by the watch. The shape memory polymer can be a composite material that provides high durability under cyclic stretching and high speed response of shape recovering while avoiding a drastic moduli drop by shape recovering.

20 Claims, 8 Drawing Sheets

WATCH BAND WITH ADJUSTABLE FIT

CROSS-REFERENCE TO RELATED APPLICATION

This application claims the benefit of U.S. Provisional Application No. 62/906,650, entitled "WATCH BAND WITH ADJUSTABLE FIT," filed Sep. 26, 2019, the entirety of each of which is incorporated herein by reference.

FIELD

The present description relates generally to watch bands, and, more particularly, to watch bands with adjustable fit for a user's wrist.

BACKGROUND

Some electronic devices may be removably attached to a user. For example, a wristwatch or fitness/health tracking device can be attached to a user's wrist by joining free ends of a watch band together.

In many cases, watch bands may have limited fit adjustment increments available. For example, some bands have an incrementally user-adjustable size (e.g., a buckling clasp, pin and eyelet, etc.) whereas other bands have a substantially fixed size, adjustable only with specialized tools and/or expertise (e.g., folding clasp, deployment clasp, snap-fit clasp, etc.). Still other bands may be elasticated expansion-type bands that stretch to fit around a user's wrist.

In many cases, conventional watch bands may catch, pinch, or pull a user's hair or skin during use if the band is overly tight. In other cases, watch bands may slide along a user's wrist, turn about a user's wrist, or may be otherwise uncomfortable or bothersome to a user if the band is overly loose. These problems can be exacerbated during periods of heightened activity, such as while running or playing sports. Furthermore, adjusting the size or fit of conventional watch bands often requires multiple steps, specialized tools, and/or technical expertise. In other cases, sizing options available to a user may be insufficient to obtain a proper fit. In still further examples, the fit may be different and/or may be perceived to be different given certain environmental (e.g. temperature, humidity) or biological conditions (e.g., sweat, inflammation). As a result, users of conventional wristwatches and/or fitness/health tracking devices may select a tolerable (although not optimally comfortable) fit, reserving tight bands for fitness/health tracking devices and loose bands for conventional wristwatches.

However, some wearable electronic devices (such as smart watches) may be multi-purpose devices, providing in one example both fitness/health tracking and timekeeping functionality. Accordingly, a user may prefer the fit of a smart watch to vary with use. For example, a user may prefer a looser fit in a timekeeping mode and a tighter fit in a fitness/health tracking mode.

Accordingly, there may be a present need for systems and methods for dynamic adjustment of the fit of wearable electronic devices.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
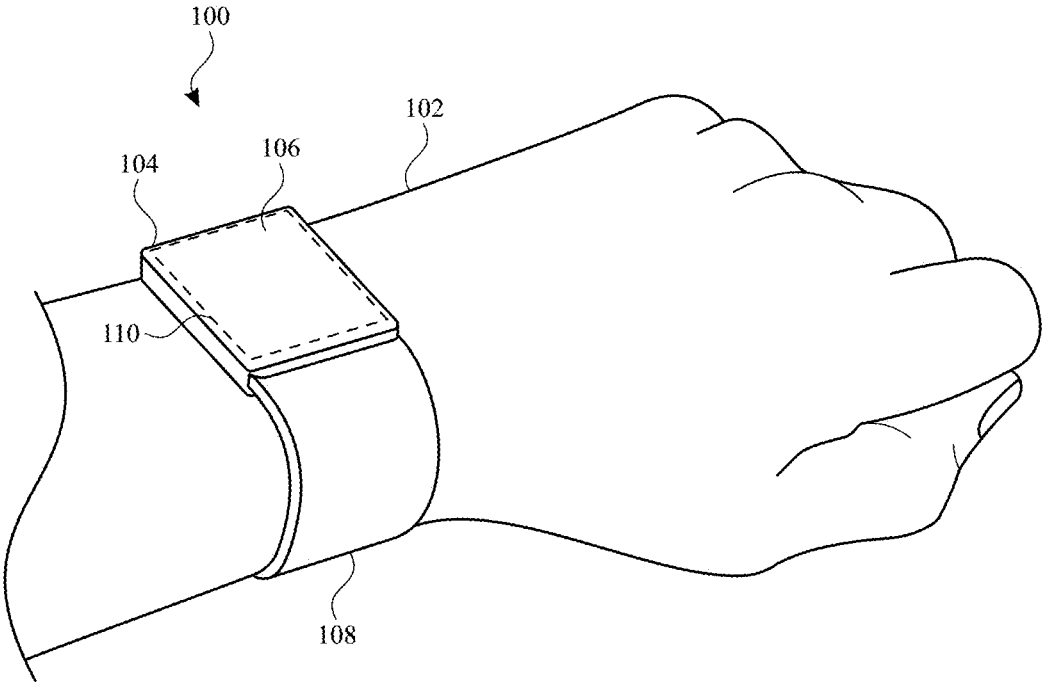
FIG. 1 illustrates a perspective view of a watch on a wrist of a user, according to some embodiments of the present disclosure.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Embodiments described herein relate to systems and methods for dynamic adjustment of the fit of wearable electronic devices. It should be appreciated that the various embodiments described herein, as well as functionality, operation, components, and capabilities thereof may be combined with other elements, embodiments, structures and the like, and so any physical, functional, or operational discussion of any element or feature is not intended to be limited solely to a particular embodiment to the exclusion of others.

As noted above, many portable electronic devices may be removably attached to a user. In some examples, a heart rate sensor may be attached to a user's chest by a strap. In another example, a smart watch or a fitness device can be attached to a user's wrist by donning the watch with a watch band and/or joining free ends of a conventional watch band together. In other examples, a clasp or an elasticated band may optionally be used to secure the watch. In another example, a portable audio player may be secured to a user's arm by inserting the player into an armband case.

Although many embodiments are described herein with reference to wrist bands for attaching a wrist-worn electronic device to a user, one may appreciate that other form factors may be favored in other embodiments. In other words, the methods, systems, and techniques described herein with illustrative reference to wrist-worn devices may be equally applied to non-wrist worn devices. For example, in other embodiments, devices may be configured to attach to other limbs or body portions (e.g., necklaces, arm bands, waistbands, ear hooks, finger rings, anklets, toe rings, chest wraps, head bands, etc.). Furthermore, other embodiments described herein may be applied to dynamically adjust the fit of an electronic device to a non-user object such as a charging stand or station. In other embodiments, an electronic device can be fit to another biological subject such as an animal (e.g., pet collar).

As noted above, many conventional watch bands may be uncomfortable, painful, or bothersome if improperly fit to a user. For example, a user's skin and/or hair may be pinched or pulled if a conventional watch band is improperly fit. In another example, a user may be irritated by a watch that slides up and down a user's wrist and/or rotates about the user's wrist during use.

In other cases, the fit of a conventional watch band may be different and/or may be perceived to be different given different situations. For example, in humid conditions, the fit of a band may be perceived to be tighter. In another example, a user who is sweating may perceive the fit of a band to be looser. In many cases, these problems can be exacerbated during periods of heightened activity, such as while running or playing sports.

Despite the prevalence of issues associated with improperly fit bands, adjusting the size or fit of conventional watch bands often requires multiple steps, specialized tools, and/or technical expertise. For example, a metal link band may require specialized tools to remove one or more links of the band to resize the band. In other cases, a leather band with a deployment clasp may need to be physically cut to size in order to resize the band.

In other cases, watch bands may have limited fit adjustment increments available. For example, a conventional watch band may space sizing eyelets approximately 8 mm apart. In some cases, a user may prefer a fit corresponding to a location between two eyelets. In some examples, especially for users having relatively small wrists, an error of ±4 mm (e.g., example of error halfway between "too tight" and "too loose") can correspond to an error upwards of ±5% of the circumference of that user's wrist, which, for many users, may be intolerable.

As a result, users of conventional wristwatches and/or fitness/health tracking devices may select a tolerable (although not optimally comfortable) fit, reserving tighter bands for fitness/health tracking devices and looser bands for conventional wristwatches.

However, as noted above, some wearable electronic devices, such as smart watches, may be multi-purpose devices. For example, many smart watches provide both fitness/health tracking and timekeeping functionality. Thus, many users may wear a smart watch exclusively, instead of periodically switching between wearing a traditional wristwatch and a separate fitness/health tracking device. In these examples, a user may prefer the fit of a smart watch to vary with use. For example, a user may prefer a looser fit in a timekeeping mode and a tighter fit in a fitness/health tracking mode.

As may be appreciated, the inconvenience associated with repeated resizing and reattachment of a conventional watchband may contribute to diminishing use of a wearable electronic device, which may, in turn, precipitate a customer retention problem for the manufacturer thereof. In other examples, such as for wearable electronic devices configured to collect health-related information (e.g., pulse rate, blood oxygen saturation, blood pressure, insulin levels, etc.) or to provide health-related notifications (e.g., prescription timing reminders, medical alerts, medical identification numbers, etc.), discontinued use of the wearable electronic device may lead to more serious consequences such as health problems, medical emergencies, and/or incomplete or inconsistent medial data collection.

Accordingly, many embodiments described herein relate to systems and methods for dynamic adjustment of the fit of the wearable electronic devices.

For example, certain embodiments described herein take the form of methods for adjusting the fit of a wearable electronic device secured by a band to a user. Features of a band can provide a capability to automatically adjust a tightness of a band without active user input. For example, a tensioning element can be provided with a capability to alter the fit of a band in response to heat emitted by a user wearing the band.

By further example, the watch can generate a signal with an instruction to adjust the fit of the band, selecting an operational mode (e.g., tightening mode, loosening mode, flexibility mode, rigid mode, etc.) of a tensioner coupled to electronic device, and actuating the tensioning element based on the instruction.

The term "tensioning element" and related phrases and terminology is used herein to generally refer to structural component of a band that changes at least one feature thereof to adjust a fit of the band on a wrist or other portion of a user. The term "tensioner" and related phrases and terminology is used herein to generally refer to a circuit, apparatus, controller, or program code executed by a processor, that is configured to cause, either directly or indirectly, tension in a band or strap coupled to an electronic device housing to increase or decrease. For example, a tensioner can apply a stimulus to a tensioning element.

In some examples, a tensioning element associated with and/or coupled to the watch can also be coupled to a portion of the band that is configured to compress in response to heat conditions. For example, a shape memory polymer can be formed in a longitudinal (e.g., serpentine) pattern within one or more portions of a band. Body heat of a user and/or heat generated by the watch can be applied to the shape memory polymer to alter its length and thereby increase or decrease the tightness of the band.

In other examples, a tensioning element associated with and/or coupled to the watch can also be coupled to a portion of the band that is configured to change an overall shape in response to heat conditions. For example, a shape memory polymer can be formed along one or more portions of a band. Body heat of a user and/or heat generated by the watch can be applied to the shape memory polymer to change its shape and thereby increase or decrease the tightness of the band.

In other examples, a tensioning element associated with and/or coupled to the watch can also be coupled to a portion of the band that is configured to change an overall shape in response to heat conditions. For example, a shape memory polymer can be formed within a thickness of at least a portion of the. Body heat of a user and/or heat generated by the watch can be applied to the shape memory polymer to change its thickness and thereby increase or decrease the tightness of the band.

These and other embodiments are discussed below with reference to FIGS. 1-18. However, those skilled in the art will readily appreciate that the detailed description given herein with respect to these figures is for explanatory purposes only and should not be construed as limiting.

FIG. 1 depicts a perspective view of a watch attached by a band to a user. In the illustrated embodiment, the watch 100 is implemented as a portable electronic device that is worn on the wrist of a user 102. Other embodiments can implement the watch differently. For example, the watch can be a smart phone, a gaming device, a digital music player, a sports accessory device, a medical device, navigation assistant, accessibility device, a device that provides time and/or weather information, a health assistant, and other types of electronic device suitable for attaching to a user.

The watch 100 includes a housing 104 and a display 106. The housing 104 can form an outer surface or partial outer surface and protective case for one or more internal components of the watch 100. In the illustrated embodiment, the housing 104 is formed into a substantially rectangular shape, although this configuration is not required and other shapes are possible in other embodiments.

In some examples, the display 106 may incorporate an input device configured to receive user input. Optionally, a user can provide input to the display 106 to indicate the user's intention to increase the tightness of the fit of the wearable device. In other examples, the user can provide a force input to the display 106, the magnitude of which can correspond to the magnitude of tightness increase in the fit the user desires to be implemented by the watch 100.

The display 106 can be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology. In many embodiments, the display 106 can be disposed below a protective cover glass formed from a rigid and scratch resistant material such as ion-implanted glass, laminated glass, or sapphire.

As noted above, the display 106 can incorporate or be disposed proximate to an input sensor. For example, in some embodiments, the display 106 can also include one or more contact sensors to determine the position of one or more contact locations on a top surface of the display 106. In some embodiments, the display 106 can also include one or more force-sensitive elements (not shown) to detect a magnitude of force applied to the top surface of the display 106.

The watch 100 can include within the housing 104 a processor, a memory, a power supply and/or battery, network communications, sensors, display screens, acoustic elements, input/output ports, haptic elements, digital and/or analog circuitry for performing and/or coordinating tasks of the watch 100, and so on. In some examples, the watch 100 can communicate with a separate electronic device via one or more proprietary and/or standardized wired and/or wireless interfaces. For simplicity of illustration, the watch 100 is depicted in FIG. 1 without many of these elements, each of which may be included, partially, optionally, or entirely, within the housing 104.

The watch 100 can be coupled to the user 102 via a band 108 that loops around the user's wrist. The band 108 can be formed from a compliant material, or into a compliant structure, that is configured to easily contour to a user's wrist, while retaining stiffness sufficient to maintain the position and orientation of the watch on the user's wrist. The material selected for the band 108 may vary from embodiment to embodiment. For example, in certain cases, the band 108 can be formed from metal, such as a band formed into a metal mesh. In other embodiments, the band 108 can be formed from an organic material such as leather. In further examples, the band 108 can be formed from an inorganic material such as nylon. In still further embodiments, materials such as plastic, rubber, or other fibrous, organic, polymeric, or synthetic materials may be used.

As can be appreciated, the relative stiffness of a band can impact the tightness with which the band may be fit to a user's wrist. For example, the more flexible the band 108, the tighter the band should be secured to prevent the watch 100 from sliding, rotating, or otherwise displacing on the user's wrist.

In some embodiments, the band 108 can be formed, at least in part, from a polymer, such as a fluoroelastomeric polymer, having a Shore durometer selected for having flexibility suitable for easily contouring to a user's wrists while maintaining sufficient stiffness to maintain support of the watch 100 when attached to the wrist of user 102. For example, bands of certain embodiments may have a Shore A durometer ranging from 60 to 80 and/or a tensile strength greater than 12 MPa.

In some embodiments, a fluoroelastomeric polymer (or other suitable polymer) can be doped or treated with one or more other materials. For example, the polymer can be doped with an agent configured to provide the polymer with a selected color, odor, taste, hardness, elasticity, stiffness, reflectivity, refractive pattern, texture and so on. In other examples, the doping agent can confer other properties to the fluoroelastomeric polymer including, but not necessarily limited to, electrical conductivity and/or insulating properties, magnetic and/or diamagnetic properties, chemical resistance and/or reactivity properties, infrared and/or ultraviolet light absorption and/or reflectivity properties, visible light absorption and/or reflectivity properties, antimicrobial and/or antiviral properties, oleophobic and/or hydrophobic properties, thermal absorption properties, pest repellant properties, colorfast and/or anti-fade properties, deodorant properties, antistatic properties, medicinal properties, liquid exposure reactivity properties, low and/or high friction properties, hypoallergenic properties, and so on.

In some embodiments, one or more doping agents may be used. In further embodiments, the doping agents associated with one area of the band 108 may be different from the doping agents associated with another area of the bands. In one example, a band may have a low friction dopant added to the portion of a band that faces a user's wrist (e.g., bottom surface) while having a high reflectivity dopant added to the portion of the band that faces outwardly (e.g., top surface).

Other embodiments described herein include configurations in which the band 108 is formed, at least in part, from a non-compliant material into a compliant structure. For example, a metallic mesh can be used to form band 108. In other embodiments, the band can be formed by joining a number of metal links. In other embodiments, the band can be formed by joining a number of glass or crystal links.

In other embodiments, the band 108 can be formed form a combination of complaint and non-compliant materials.

In some examples, the band 108 can be removably coupled to the housing 104. For example, in certain embodiments, the band 108 can be at least partially looped around a watch pin that is configured to insert within lugs extending from the body of the housing 104. In other examples, the band 108 can be configured to slide within and be retained by two or more channels within external sidewalls of the housing 104. In other examples, the band 108 can be looped through and aperture in the housing 104. In other cases, the band 108 can be riveted, screwed, or otherwise attached to the housing 104 via one or more mechanical fasteners. In still further embodiments, additional removable couplings between the band 108 and the housing 104 are possible.

In other examples, the band 108 can be permanently coupled to the housing 104. For example, in some cases, the band 108 may be formed as an integral portion of the housing 104. In other cases, the band 108 can be rigidly adhered to the housing 104 via an adhesive. In still further embodiments, the band 108 can be welded, soldered, or chemically bonded to the housing 104. In other embodiments, additional permanent couplings between the band 108 and the housing 104 are possible.

As noted above, the housing 104 may be rigid and can be configured to provide structural support and impact resistance for electronic or mechanical components contained therein. A rigid housing is not necessarily required for all embodiments and, in some examples, the watch 100 can have a housing may be flexible. Furthermore, although watch housings are typically formed to take a rectangular shape, this is not required and other shapes are possible. For example, certain housings may take a circular shape.

In other embodiments, the watch 100 can include one or more sensors (not shown) positioned on a bottom surface of the housing 104. Sensors utilized by the watch 100 can vary from embodiment to embodiment. Suitable sensors can include temperature sensors, electrodermal sensors, blood pressure sensors, heart rate sensors, respiration rate sensors, oxygen saturation sensors, plethysmographic sensors, activity sensors, pedometers, blood glucose sensors, body weight sensors, body fat sensors, blood alcohol sensors, dietary sensors, and so on.

In many cases, sensors such as biometric sensors can collect certain health-related information non-invasively. For example, the watch 100 can include a sensor that is configured to measure changes in (or an amount of) light reflected from a measurement site (e.g., wrist) of the user 102. In one embodiment, the biometric sensor such as a PPG sensor can include a light source for emitting light onto or into the wrist of the user 102 and an optical sensor to detect light exiting the wrist of the user 102. Light from the light source may be scattered, absorbed, and/or reflected throughout the measurement sight as a function of various physiological parameters or characteristics of the user 102. For example, the tissue of the wrist of the user 102 can scatter, absorb, or reflect light emitted by the light source differently depending on various physiological characteristics of the surface and subsurface of the user's wrist.

In many cases a PPG sensor can be used to detect a user's heart rate and blood oxygenation. For example, during each complete heartbeat, a user's subcutaneous tissue can distend and contract, alternatingly increasing and decreasing the light absorption capacity of the measurement site. In these embodiments, the optical sensor of the PPG can collect light exiting the measurement site and generate electrical signals corresponding to the collected light. Thereafter, the electrical signals can be conveyed as raw data to the watch 100, which in turn can process the raw data into health data 110. The raw data can be based on information about the collected light, such as the chromaticity and/or luminance of the light. In some cases, the health data 110 can be shown on the display 106 as biometric feedback to the user 102.

However, certain sensors such as PPG sensors may be susceptible to noise associated with ambient light, surface conditions of the measurement site (e.g., cleanliness, hair, perspiration, etc.), proximity of the optical sensor and/or light source to the measurement site, and motion artifacts caused by the relative motion between the watch 100 and the user 102. As a result, if the watch 100 is not snugly fit to the user 102 (at least while the PPG sensor is obtaining a measurement), the health data 110 obtained from the sensor may be sub-optimal (e.g., insufficient or insignificant magnitude) as a direct result of the improper fit. Alternatively, if the watch 100 is snugly fit to the user 102, the health data 110 obtained from the sensor may be of substantially improved quality, magnitude, and clarity.

It will be understood that in certain embodiments, the watch 100 may dynamically resize the band 108 and/or the fit of the watch 100 for reasons unrelated to sensor data quality. For example, as mentioned above, a tensioning element (not shown) can be coupled to the watch 100. In some examples, the tensioning element can be included within the housing 104. In other examples, the tensioning element can be included within the band 108. In still further examples, a portion of the tensioning element can be included within the housing 104 and a portion of the tensioning element can be included within the band 108. In some examples, the tensioning element can be coupled to the band 108 and to the housing 104. For example, the tensioning element can take the form of a coupling and/or a lug by which the band 108 couples to the housing 104.

Figure 2:
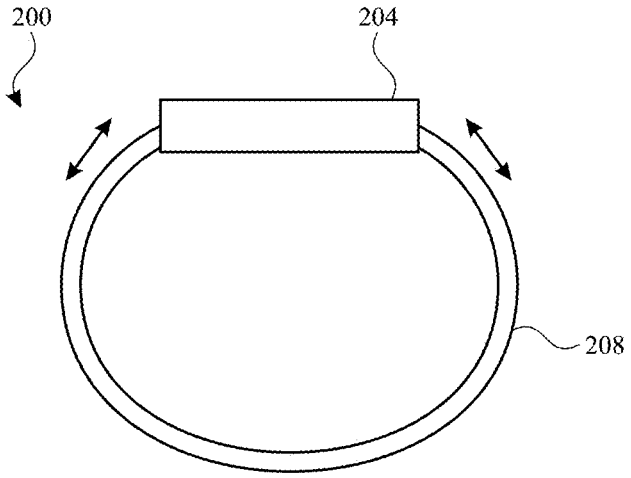
FIG. 2 illustrates a side view of a watch with adjustable fit capabilities, according to some embodiments of the present disclosure.
Figure 3:
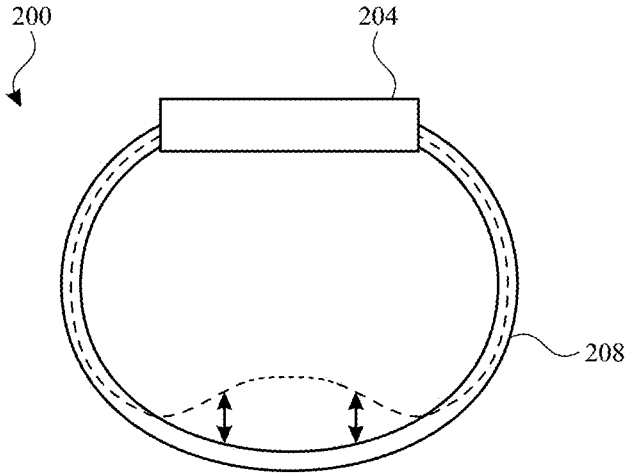
FIG. 3 illustrates a side view of a watch with adjustable fit capabilities, according to some embodiments of the present disclosure.
Figure 4:
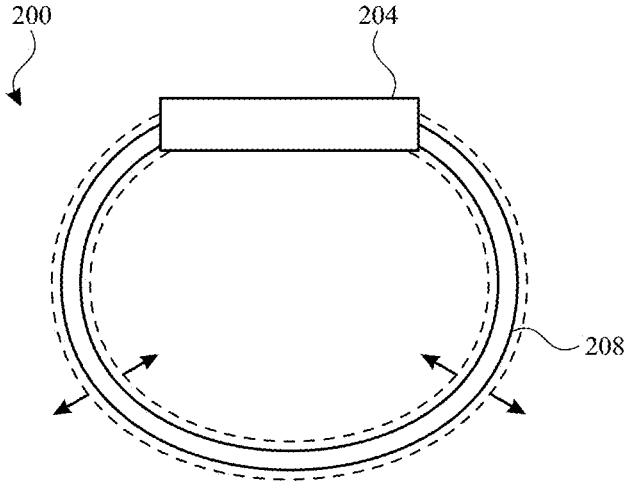
FIG. 4 illustrates a side view of a watch with adjustable fit capabilities, according to some embodiments of the present disclosure.

FIGS. 2-4 depict side views of a watch 200 with a band 208 for attaching to a user. The watch 200 can include one or more of the features discussed herein with respect to the watch 100. For example, as with the embodiment depicted in FIG. 1, the watch 200 can include a housing 204 and a display that may incorporate an input device configured to receive touch input, force input, or other input from a user. The housing 204 may also include one or more buttons or input ports (not shown). The housing 204 can be permanently or removably attached to a band 208.

As with the embodiment depicted in FIG. 1, the band 208 can be formed from a compliant material or into a compliant structure that is configured to easily contour to a user's wrist, while retaining stiffness sufficient to maintain the position and orientation of the watch on the user's wrist. The band 208 is illustrated as a single, continuous structure extending from opposing ends of the housing 204. Additionally or alternatively, the band 208 can include overlapped components to form a closed loop around a user's wrist. In these examples, the separate components can be affixed together with a traditional or conventional attachment mechanism. For example, in some embodiments, a buckling clasp can be used. In other examples a pin and eyelet attachment mechanism can be used.

The watch 200 can include a tensioner (not illustrated) in order to provide dynamic adjustment of the fit of the watch 200. As with other embodiments described herein, the tensioner may alter the fit of the watch 200 in a number of ways. For example, the tensioner can adjust one or more dimensions of a band coupled to the watch. In another example, the tensioner can adjust a coupling between a band and the watch. In another example the tensioner can adjust the position of the housing of the watch relative to the band. In still other embodiments, other adjustments are possible.

In some embodiments, as shown in FIG. 2, the length of the band 208 can be increased or decreased in order to adjust the fit of the watch 200. This type of adjustment can be referred to as a "fastening force." In these embodiments, the shorter the length of the band 208, the tighter the fit of the watch 200 may be. Similarly, the longer the length of the band 208, the looser the fit of the watch 200 may be. Length adjustments to the band 208 are shown in FIG. 2 with bi-directional arrows. As shown, the length need not change along every portion of the band 208.

In some embodiments, as shown in FIG. 3, the shape of the band 208 can be adjusted in order to adjust the fit of the watch 200. This type of adjustment can be referred to as a "coiling force." For example, a cross-sectional shape of the band 208 can be defined by an inner periphery of the band 208, such as along a user engagement surface of the band 208. The band 208 can define multiple cross-sectional dimensions, defined by a distance between opposing inner surfaces of the band 208. It will be understood that the housing 204 can also provide an end that defines the cross-sectional dimension. Where a change of the shape of the band 208 changes at least one cross-sectional dimension of the band 208, the fit of the watch 200 can be altered by changing a force applied by the portions of the band 208 that define the altered cross-sectional dimension. In these embodiments, the shorter the cross-sectional dimension of the band 208, the tighter the fit of the watch 200 may be. Similarly, the greater the cross-sectional dimension of the band 208, the looser the fit of the watch 200 may be. Shape adjustments to the band 208 are shown in FIG. 3 with bi-directional arrows. As shown, the shape need not change along every portion of the band 208.

In some embodiments, as shown in FIG. 4, the thickness of the band 208 can be increased or decreased in order to adjust the fit of the watch 200. This type of adjustment can be referred to as a "pressure." In these embodiments, the thicker the band 208, the tighter the fit of the watch 200 may be. Similarly, the thinner the band 208, the looser the fit of the watch 200 may be. Thickness adjustments to the band 208 are shown in FIG. 4 with a bi-directional arrows. As shown, the thickness need not change along every portion of the band 208.

It will be understood that any given band can provide one or more of the adjustments illustrated in FIGS. 2-4 and/or other adjustments. It will be further understood that the adjustments illustrated in FIGS. 2-4 and/or other adjustments may apply equally or equivalently to other band and/or watch embodiments described herein. More generally, it should be appreciated that the various examples and embodiments presented herein can apply equally or equivalently to many band and/or watches and no single embodiment, or adjustments thereto by a tensioner or the watch itself, should be considered as limited to that single embodiment.

Figure 5:
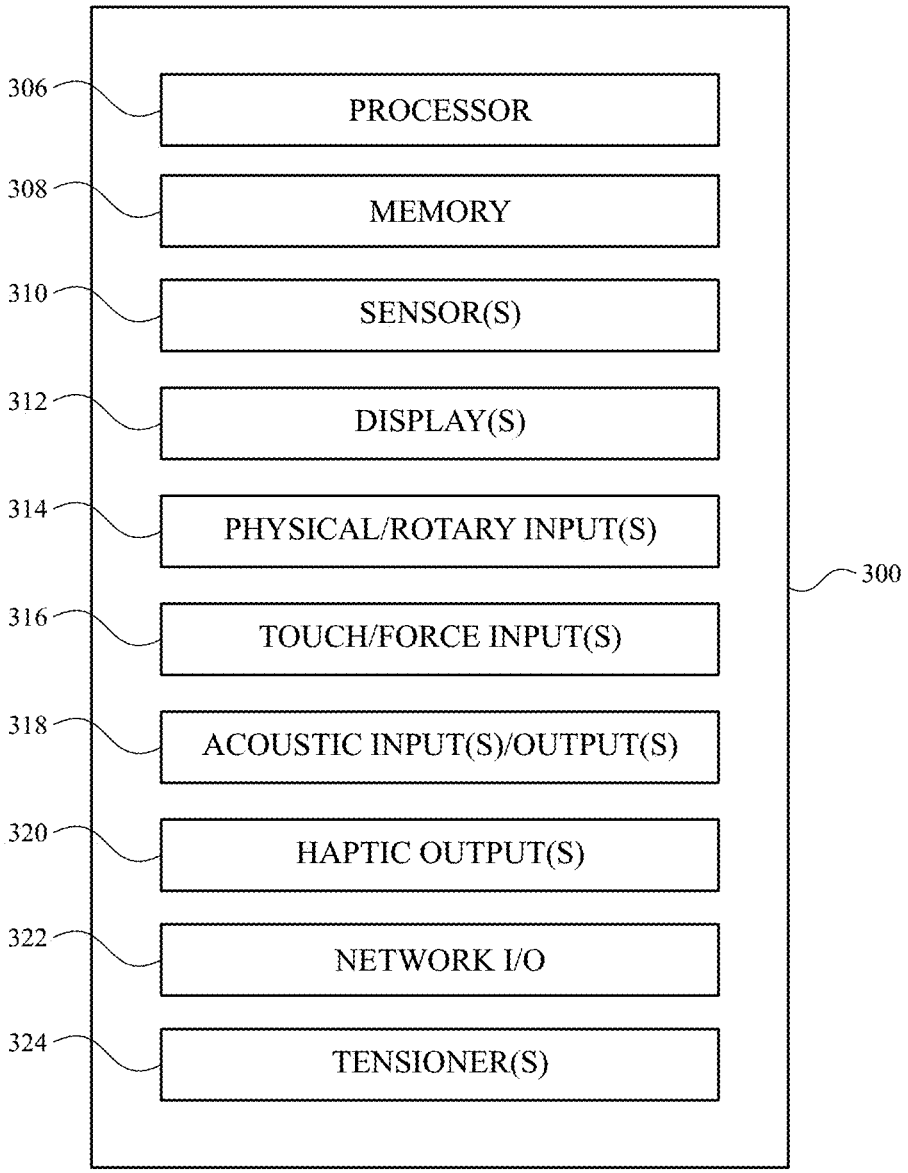
FIG. 5 depicts a simplified block diagram of a watch, according to some embodiments of the present disclosure.

FIG. 5 depicts a simplified block diagram of a watch 300 configured to be coupled to a user with a band about the user's wrist. The watch 300 can one or more processing devices 306, memory 308, one or more input/output (I/O) devices or sensors 310 (e.g., biometric sensors, environmental sensors, etc.), one or more displays 312, one or more power source(s) (not shown), one or more physical and/or rotary input devices 314, one or more touch and/or force input device(s) 316, one or more acoustic input and/or output devices 318, one or more haptic output device(s) 320, one or more a network communication interface(s) 322, and one or more tensioner 324. Some embodiments can also include additional components.

The display 312 may provide an image or video output for the watch 300. The display 312 may also provide an input surface for one or more input devices such as a touch sensing device 316, force sensing device, temperature sensing device, and/or a fingerprint sensor. The display 312 may be any size suitable for inclusion at least partially within the housing of the watch 300 and may be positioned substantially anywhere on the watch 300. In some embodiments, the display 312 can be protected by a cover glass formed from a scratch-resistant material (e.g., sapphire, zirconia, glass, and so on) that may form a substantially continuous external surface with the housing of the watch 300.

The processing device(s) 306 can control or coordinate some or all of the operations of the watch 300. The processing device 306 can communicate, either directly or indirectly with substantially all of the components of the watch 300. For example, a system bus or signal line or other communication mechanisms can provide communication between the processing device 306, the memory 308, the I/O device(s) 310, the power source(s), the network communication interface 322, and/or the haptic output device 320.

The one or more processing devices 306 can be implemented as any electronic device capable of processing, receiving, or transmitting data or instructions. For example, the processing device(s) 306 can each be a microprocessor, a central processing unit (CPU), an application-specific integrated circuit (ASIC), a digital signal processor (DSP), or combinations of such devices. As described herein, the term "processing device" is meant to encompass a single processor or processing unit, multiple processors, multiple processing units, or other suitably configured computing element or elements.

The memory 308 can store electronic data that can be used by the watch 300. For example, a memory can store electrical data or content such as, for example, audio and video files, documents and applications, device settings and user preferences, timing and control signals or data for the haptic output device 320, data structures or databases, and so on. The memory 308 can be configured as any type of memory. By way of example only, the memory can be implemented as random access memory, read-only memory, Flash memory, removable memory, or other types of storage elements, or combinations of such devices.

The one or more I/O device(s) 310 can transmit and/or receive data to and from a user or another electronic device. The I/O device(s) 310 can include a touch sensing input surface such as one or more buttons, one or more microphones or speakers, and/or one or more ports such as a microphone port.

The watch 300 may also include one or more sensors 310 positioned substantially anywhere on the watch 300. The sensor or sensors 310 may be configured to sense substantially any type of characteristic such as, but not limited to, images, pressure, light, touch, force, temperature, position, motion, and so on. For example, the sensor(s) 310 may be an image sensor, a temperature sensor, a light or optical sensor, an atmospheric pressure sensor, a humidity sensor, a magnet, a gyroscope, an accelerometer, and so on. In other examples, the watch 300 may include one or more health sensors. In some examples, the health sensors can be disposed on a bottom surface of the housing of the watch 300.

The power source can be implemented with any device capable of providing energy to the watch 300. For example, the power source can be one or more batteries or rechargeable batteries, or a connection cable that connects the remote control device to another power source such as a wall outlet. In other examples, wireless power can be used.

The network communication interface 322 can facilitate transmission of data to or from other electronic devices across standardized or proprietary protocols. For example, a network communication interface can transmit electronic signals via a wireless and/or wired network connection. Examples of wireless and wired network connections include, but are not limited to, cellular, Wi-Fi, Bluetooth, infrared, and Ethernet.

The haptic output device 320 can be implemented as any suitable device configured to provide force feedback, vibratory feedback, tactile sensations, and the like. For example, in one embodiment, the haptic output device 320 may be implemented as a linear actuator configured to provide a punctuated haptic feedback, such as a tap or a knock.

As noted above, the watch 300 can include a tensioner 324. In some embodiments, a tensioner can be an analog, digital, or integrated circuit configured to apply a stimulus to cause tension (either directly or indirectly) to be applied to, or relieved form, the band. For example, a tensioner can apply heat and/or another stimulus directly and/or indirectly to the band to induce a temperature and/or a temperature change and cause the band to adjust a feature thereof and thereby adjust a fit on a user.

As noted above, the signal to change the fit of the watch 300 can be received from any number of sources. For example, in certain embodiments, the signal can be received from secondary electronic device through the network communication interface 322. In other embodiments, the signal can be received as direct user input. For example, a user can provide input to the touch sensing device 316 of the watch 300 to indicate to the watch 300 and/or the tensioner 324 the user's desire for the fit of the device to change, either with increased tightness or decreased tightness.

Figure 6:
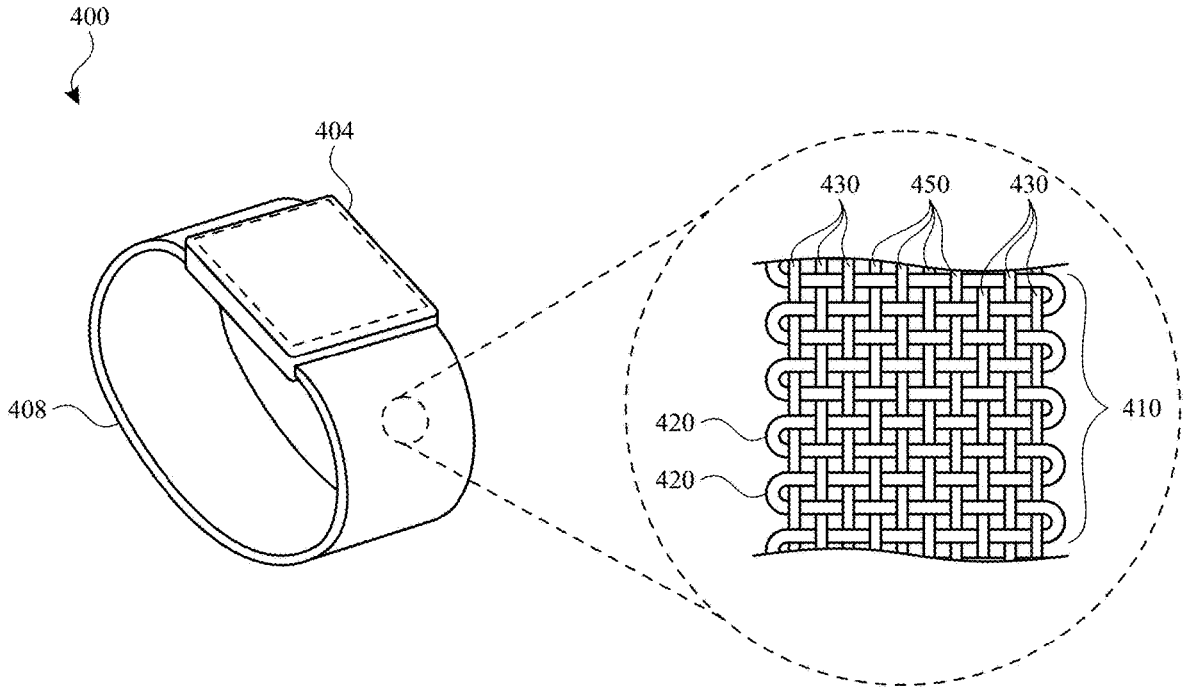
FIG. 6 illustrates a perspective view of a watch with an expanded view of a portion of a watch band, according to some embodiments of the present disclosure.

Referring now to FIG. 6, a watch band can provide an ability to adjust a fit on a user with interwoven strands. For example, a watch band can include at least one strand of a shape memory polymer that changes a characteristic thereof in response to a stimulus, such as heat and/or an induced temperature or temperature change. The shape memory polymer can provide an ability to reversibly change the fit of the watch band.

FIG. 6 illustrates a view of a watch 400 with a band 408 for securing a housing 404 to a user. The watch 400 can include one or more of the features discussed herein with respect to the watch 100, the watch 200, and/or the watch 300. For example, as with the embodiment depicted in FIG. 1, the watch 400 can include a housing 404 with a display that may incorporate an input device configured to receive touch input, force input, or other input from a user. The housing 404 may also include one or more buttons or input ports (not shown). The housing 404 can be permanently or removably attached to the band 408.

As further shown in FIG. 6, the band 408 can be formed as a fabric 410 of interwoven strands. For example, a number of strands can include one or more warp strands and one or more weft strands combined in a plain weave or another type of weave. In general, the fabric 410 may include any intertwined strands (woven, knitted, braided, etc.). The plain weave fabric of FIG. 6 is merely illustrative, and it will be appreciated that other weave configurations are contemplated.

Some or all of the strands can include tensioning elements that respond to a stimulus and adjust a fit of the band. For example, as shown in FIG. 6, at least some of the warp strands can include tensioning elements 450 among other warp strands 430. In some embodiments, the tensioning elements 450 can be positioned along an inner section of the fabric 410, and the other warp strands 430 can be positioned along outer sections of the fabric 410, such as those defining, at least in part, an outer edge of the fabric 410. Additionally or alternatively, the tensioning elements 450 can be positioned along outer sections of the fabric 410 and/or all of the warp strands can be tensioning elements 450. Additionally or alternatively, one or more weft strands 420 can be tensioning elements.

The tensioning elements 450 can include one or more shape memory polymers that respond to a stimulus, such as heat. For example, the user and/or the watch can apply a stimulus, such as heat and/or an induced temperature or temperature change to the tensioning elements 450. Such a stimulus can be applied passively, such as when the band 408 is worn by a user, when the user raises the user's own body temperature, and/or when a user increases an amount of heat emitted. Additionally or alternatively, a stimulus can be actively applied, such as by a tensioner operated at the housing 404 of the watch 400 to emit heat and/or induce a temperature or temperature change in the tensioning elements 450. In response, the shape memory polymer of the tensioning elements 450 can provide an ability to reversibly change the fit of the watch band by changing a characteristic of the tensioning elements 450. For example, the tensioning elements 450 can change to adjust a length of the band 408 in a manner similar to the change illustrated in FIG. 2. By further example, the tensioning elements 450 can change to adjust a shape of the band 408 in a manner similar to the change illustrated in FIG. 3. By further example, the tensioning elements 450 can change to adjust a thickness of the band 408 in a manner similar to the change illustrated in FIG. 4. Other components of the band 408 (e.g., other warp strands and/or weft strands) can adjust to match or otherwise accommodate the change in the tensioning elements 450. Accordingly, the tensioning elements 450 can respond to a stimulus to adjust a fit of the band 408 on a wrist of the user.

Figure 7:
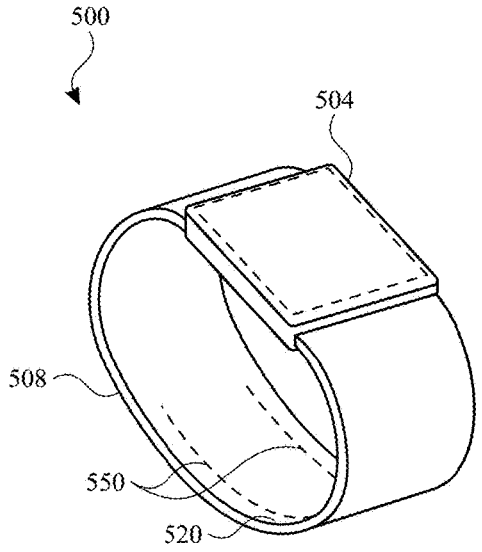
FIG. 7 illustrates a perspective view of a watch with a watch band in a loose configuration, according to some embodiments of the present disclosure.
Figure 8:
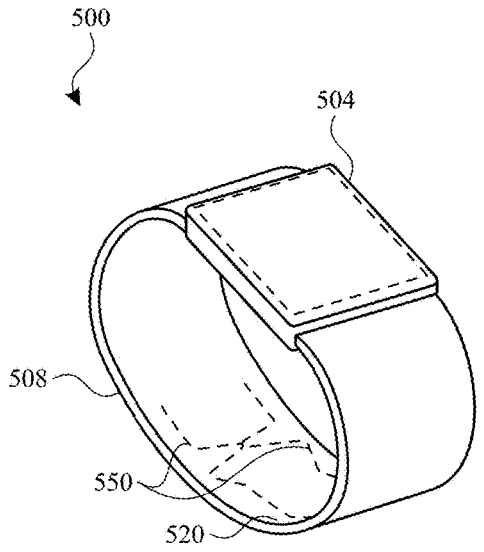
FIG. 8 illustrates a perspective view of the watch of FIG. 7 with the watch band in a tight configuration, according to some embodiments of the present disclosure.

Referring now to FIGS. 7 and 8, a watch band can provide an ability to adjust a fit on a user with a tensioning element that changes between a straight configuration and a curved configuration. For example, a watch band can include at least one tensioning element of a shape memory polymer that changes a characteristic thereof in response to a stimulus, such as heat and/or an induced temperature or temperature change. The shape memory polymer can provide an ability to reversibly change the fit of the watch band.

FIGS. 7 and 8 illustrate views of a watch 500 with a band 508 for securing a housing 504 to a user. The watch 500 can include one or more of the features discussed herein with respect to the watch 100, the watch 200, and/or the watch 300. For example, as with the embodiment depicted in FIG.

1, the watch 500 can include a housing 504 with a display that may incorporate an input device configured to receive touch input, force input, or other input from a user. The housing 504 may also include one or more buttons or input ports (not shown). The housing 504 can be permanently or removably attached to the band 508.

As shown in FIG. 7, the band 508 can include one or more tensioning elements 550 optionally within or otherwise coupled to a cover 520. The cover 520 can be formed from a material having flexibility suitable for easily contouring to a user's wrists while maintaining sufficient stiffness to maintain support of the watch 500 when attached to the wrist of user. The tensioning elements 550 can extend within and/or along the cover 520 and coupled thereto at least at the ends of the tensioning elements 550. The tensioning elements 550 can optionally extend along an entirety or only a portion of a total length of the band 508. In some embodiments, the tensioning elements 550 are positioned opposite the housing 504.

Some or all of the tensioning elements can respond to a stimulus and adjust a fit of the band. For example, as shown in FIG. 7, the tensioning elements 550 can have a straight configuration. In the straight configuration, the tensioning elements 550 can be substantially straight. As used herein, a tensioning element is substantially straight when the curvature thereof does not cause a total width of the shape formed by the tensioning element to be more than double the cross-sectional dimension at any portion of the tensioning element. Where multiple tensioning elements 550 are provided, the tensioning elements 550 can be substantially parallel to each other while in the straight configuration.

By further example, as shown in FIG. 8, the tensioning elements 550 can have a curved configuration. In the curved configuration, the tensioning elements 550 can be substantially curved and/or serpentine. As used herein, a tensioning element is substantially curved and/or serpentine when the curvature thereof causes a total width of the shape formed by the tensioning element to be more than double the cross-sectional dimension at any portion of the tensioning element. As such, the induced curvature along the length of the tensioning elements 550 can shorten the total length thereof, thereby creating tension and shortening of the length of the band 508.

The tensioning elements 550 can include one or more shape memory polymers that respond to a stimulus, such as heat. For example, the user and/or the watch can apply a stimulus, such as heat and/or an induced temperature or temperature change to the tensioning elements 550. Such a stimulus can be applied passively, such as when the band 508 is worn by a user, when the user raises the user's own body temperature, and/or when a user increases an amount of heat emitted. Additionally or alternatively, a stimulus can be actively applied, such as by a tensioner operated at the housing 504 of the watch 500 to emit heat and/or induce a temperature or temperature change in the tensioning elements 550. In response, the shape memory polymer of the tensioning elements 550 can provide an ability to reversibly change the fit of the watch band by changing a characteristic of the tensioning elements 550. For example, the tensioning elements 550 can change to adjust a length of the band 508 in a manner similar to the change illustrated in FIG. 2. By further example, the tensioning elements 550 can change to adjust a shape of the band 508 in a manner similar to the change illustrated in FIG. 3. By further example, the tensioning elements 550 can change to adjust a thickness of the band 508 in a manner similar to the change illustrated in FIG. 4. Other components of the band 508 (e.g., the cover 520) can adjust to match or otherwise accommodate the change in the tensioning elements 550. Accordingly, the tensioning elements 550 can respond to a stimulus to adjust a fit of the band 508 on a wrist of the user.

Figure 9:
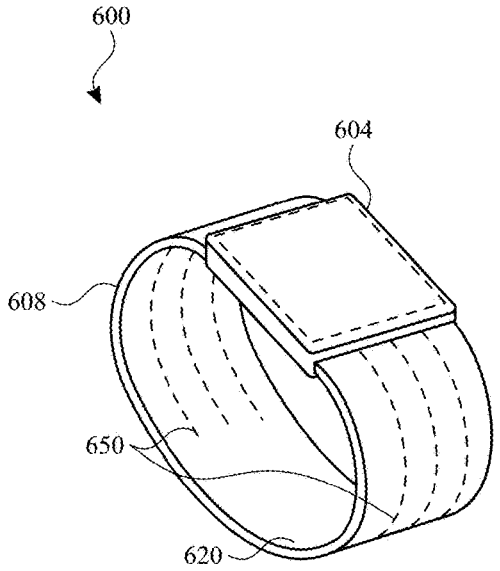
FIG. 9 illustrates a perspective view of a watch with a watch band in a loose configuration, according to some embodiments of the present disclosure.
Figure 10:
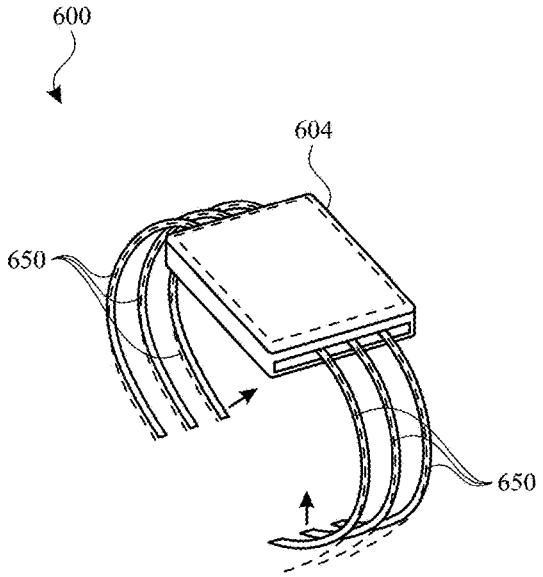
FIG. 10 illustrates a perspective view of a portion of the watch of FIG. 9, according to some embodiments of the present disclosure.

Referring now to FIGS. 9 and 10, a watch band can provide an ability to adjust a fit on a user with a tensioning element that changes between an extended configuration and a retracted configuration. For example, a watch band can include at least one tensioning element of a shape memory polymer that changes a characteristic thereof in response to a stimulus, such as heat and/or an induced temperature or temperature change. The shape memory polymer can provide an ability to reversibly change the fit of the watch band.

FIGS. 9 and 10 illustrate views of a watch 600 with a band 608 for securing a housing 604 to a user. The watch 600 can include one or more of the features discussed herein with respect to the watch 100, the watch 200, and/or the watch 300. For example, as with the embodiment depicted in FIG. 1, the watch 600 can include a housing 604 with a display that may incorporate an input device configured to receive touch input, force input, or other input from a user. The housing 604 may also include one or more buttons or input ports (not shown). The housing 604 can be permanently or removably attached to the band 608.

As shown in FIG. 9, the band 608 can include one or more tensioning elements 650 optionally within or otherwise coupled to a cover 620. The cover 620 can be formed from a material having flexibility suitable for easily contouring to a user's wrists while maintaining sufficient stiffness to maintain support of the watch 600 when attached to the wrist of user. The tensioning elements 650 can extend within and/or along the cover 620 and coupled thereto at least at the ends of the tensioning elements 650. The tensioning elements 650 can optionally extend along an entirety or only a portion of a total length of the band 608. In some embodiments, the tensioning elements 650 extend away from the housing 604 while the band 608 is coupled thereto. The tensioning elements 650 may extend away from opposing sides of the housing 604, such that opposing tensioning elements 650 do or do not reach each other in a region of the band 608 that is opposite the housing 604. Multiple tensioning elements 650 can extend (e.g., in parallel) from either or both of the ends of the housing 604 (e.g., at watch engagement elements at the ends of the band 608).

Some or all of the tensioning elements can respond to a stimulus and adjust a fit of the band. For example, as shown in FIG. 10, the tensioning elements 650 can have an extended configuration. In the extended configuration, the tensioning elements 650 can define an end that is a distance away from the housing 604. By further example, as further shown in FIG. 10, the tensioning elements 650 can have a retracted configuration. In the retracted configuration, the tensioning elements 650 can shift to bring ends or another portion thereof closer to the housing 604. As such, the induced change along the length of the tensioning elements 650 can change a distance between the band 608 and the housing 604, thereby creating a tighter fit on the wrist of the user.

The tensioning elements 650 can include one or more shape memory polymers that respond to a stimulus, such as heat. For example, the user and/or the watch can apply a stimulus, such as heat and/or an induced temperature or temperature change to the tensioning elements 650. Such a stimulus can be applied passively, such as when the band 608 is worn by a user, when the user raises the user's own body temperature, and/or when a user increases an amount of heat emitted. Additionally or alternatively, a stimulus can be actively applied, such as by a tensioner operated at the housing 604 of the watch 600 to emit heat and/or induce a temperature or temperature change in the tensioning elements 650. In response, the shape memory polymer of the tensioning elements 650 can provide an ability to reversibly change the fit of the watch band by changing a characteristic of the tensioning elements 650. For example, the tensioning elements 650 can change to adjust a length of the band 608 in a manner similar to the change illustrated in FIG. 2. By further example, the tensioning elements 650 can change to adjust a shape of the band 608 in a manner similar to the change illustrated in FIG. 3. By further example, the tensioning elements 650 can change to adjust a thickness of the band 608 in a manner similar to the change illustrated in FIG. 4. Other components of the band 608 (e.g., the cover 620) can adjust to match or otherwise accommodate the change in the tensioning elements 650. Accordingly, the tensioning elements 650 can respond to a stimulus to adjust a fit of the band 608 on a wrist of the user.

Figure 11:
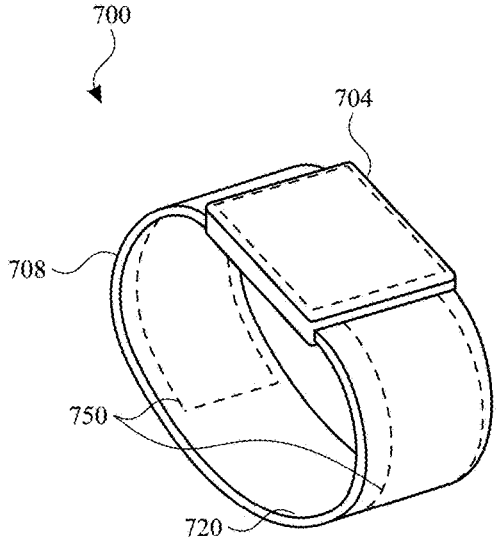
FIG. 11 illustrates a perspective view of a watch with a watch band in a loose configuration, according to some embodiments of the present disclosure.
Figure 12:
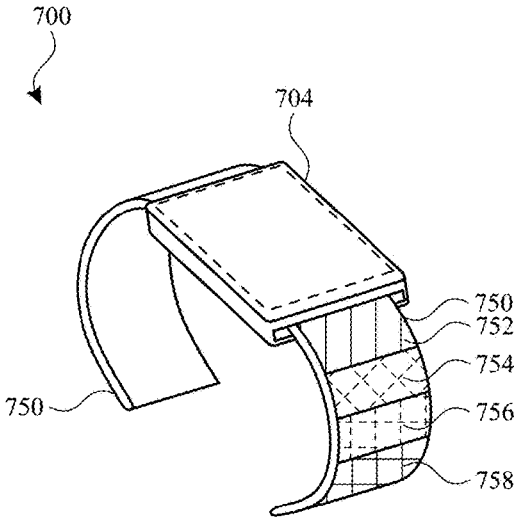
FIG. 12 illustrates a perspective view of a portion of the watch of FIG. 11, according to some embodiments of the present disclosure.
Figure 13:
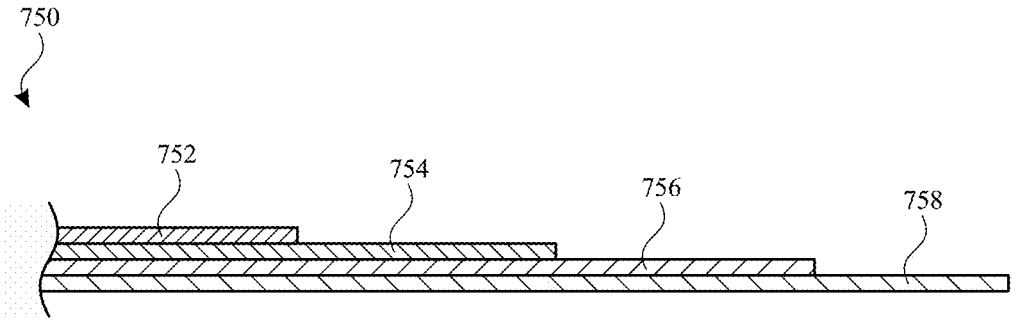
FIG. 13 illustrates a sectional view of a watch band of the watch of FIG. 12, according to some embodiments of the present disclosure.

Referring now to FIGS. 11-13, a watch band can provide an ability to adjust a fit on a user with a tensioning element that changes between a straight configuration and a curved configuration. For example, a watch band can include at least one tensioning element of a shape memory polymer that changes a characteristic thereof in response to a stimulus, such as heat and/or an induced temperature or temperature change. The shape memory polymer can provide an ability to reversibly change the fit of the watch band.

FIGS. 11 and 12 illustrate views of a watch 700 with a band 708 for securing a housing 704 to a user. The watch 700 can include one or more of the features discussed herein with respect to the watch 100, the watch 200, and/or the watch 300. For example, as with the embodiment depicted in FIG. 1, the watch 700 can include a housing 704 with a display that may incorporate an input device configured to receive touch input, force input, or other input from a user. The housing 704 may also include one or more buttons or input ports (not shown). The housing 704 can be permanently or removably attached to the band 708.

As shown in FIG. 11, the band 708 can include one or more tensioning elements 750 optionally within or otherwise coupled to a cover 720. The cover 720 can be formed from a material having flexibility suitable for easily contouring to a user's wrists while maintaining sufficient stiffness to maintain support of the watch 700 when attached to the wrist of user. The tensioning elements 750 can extend within and/or along the cover 720 and coupled thereto at least at the ends of the tensioning elements 750. The tensioning elements 750 can optionally extend along an entirety or only a portion of a total length of the band 708. In some embodiments, the tensioning elements 750 extend away from the housing 704 while the band 708 is coupled thereto. The tensioning elements 750 may extend away from opposing sides of the housing 704, such that opposing tensioning elements 750 do or do not reach each other in a region of the band 708 that is opposite the housing 704.

Some or all of the tensioning elements can respond to a stimulus and adjust a fit of the band. For example, the tensioning elements 750 can have an extended configuration. In the extended configuration, the tensioning elements 750 can define an end that is a distance away from the housing 704. By further example, the tensioning elements 750 can have a retracted configuration. In the retracted configuration, the tensioning elements 750 can shift to bring ends or another portion thereof closer to the housing 704 and/or toward each other. As such, the induced change along the length of the tensioning elements 750 can change a distance between the band 708 and the housing 704, thereby creating a tighter fit on the wrist of the user.

The tensioning elements 750 can include one or more stacked layers that provide, individually or in combination, different responses along a length of the band 708. For example, as shown in FIGS. 12 and 13, a given one of the tensioning elements 750 can include a first layer 752, a second layer 754, a third layer 756, and/or a fourth layer 758. It will be understood that fewer and/or a greater number of layers can be included. Each of the layers can extend a different distance and/or to a different portion of the band 708. For example, each of the layers can extend from a single location, such as from a watch engagement element of the band 708 where the band 708 attaches to the housing 704. Each of the layers can further extend to a different location. The length of each layer can be longer and/or shorter than that of an adjacent layer. For example, the shortest one of the layers can be closer than any other layer to an inner or outer surface of the band 708. By further example, the longest one of the layers can be closer than any other layer to an inner or outer surface of the band 708. The layers can be of the same or different materials. The layers can have the same or different widths. The layers can have the same or different thicknesses. The arrangement of the layers and characteristics thereof can allow the tensioning elements 750 to provide different responses to a single stimulus along the length of the band 708.

The tensioning elements 750 can include one or more shape memory polymers that respond to a stimulus, such as heat. For example, the user and/or the watch can apply a stimulus, such as heat and/or an induced temperature or temperature change to the tensioning elements 750. Such a stimulus can be applied passively, such as when the band 708 is worn by a user, when the user raises the user's own body temperature, and/or when a user increases an amount of heat emitted. Additionally or alternatively, a stimulus can be actively applied, such as by a tensioner operated at the housing 704 of the watch 700 to emit heat and/or induce a temperature or temperature change in the tensioning elements 750. In response, the shape memory polymer of the tensioning elements 750 can provide an ability to reversibly change the fit of the watch band by changing a characteristic of the tensioning elements 750. For example, the tensioning elements 750 can change to adjust a length of the band 708 in a manner similar to the change illustrated in FIG. 2. By further example, the tensioning elements 750 can change to adjust a shape of the band 708 in a manner similar to the change illustrated in FIG. 3. By further example, the tensioning elements 750 can change to adjust a thickness of the band 708 in a manner similar to the change illustrated in FIG. 4. Other components of the band 708 (e.g., the cover 720) can adjust to match or otherwise accommodate the change in the tensioning elements 750. Accordingly, the tensioning elements 750 can respond to a stimulus to adjust a fit of the band 708 on a wrist of the user.

Figure 14:
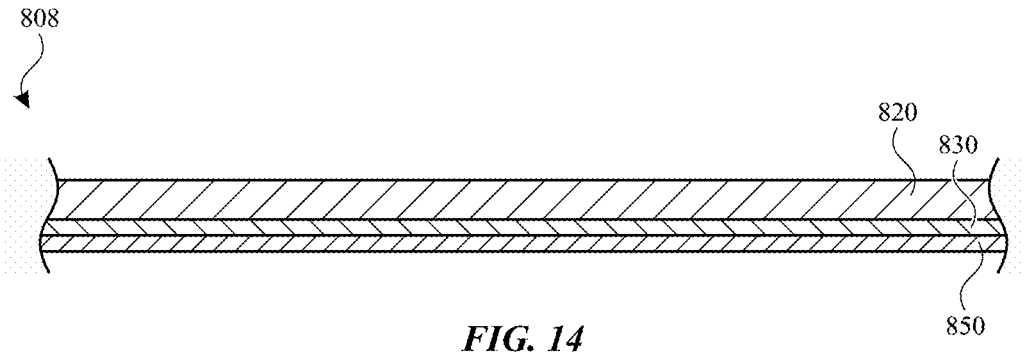
FIG. 14 illustrates a sectional view of a watch band of a watch, according to some embodiments of the present disclosure.

Referring now to FIG. 14, a watch band can provide an ability to adjust a fit on a user with a tensioning element that is one of multiple layers forming the watch band. For example, a watch band can include at least one tensioning element layer of a shape memory polymer that changes a characteristic thereof in response to a stimulus, such as heat and/or an induced temperature or temperature change. The shape memory polymer can provide an ability to reversibly change the fit of the watch band.

FIG. 14 illustrates a view of a band 808 for securing a housing to a user. The watch can include one or more of the features discussed herein with respect to the watch 100, the watch 200, and/or the watch 300. For example, as with the embodiment depicted in FIG. 1, the watch can include a housing with a display that may incorporate an input device configured to receive touch input, force input, or other input from a user. The housing may also include one or more buttons or input ports (not shown). The housing can be permanently or removably attached to the band.

As shown in FIG. 14, the band 808 can include multiple layers. The tensioning element 850 can form a layer, such as an exterior layer of the band 808. At least one other layer, such as a support layer 820, can be provided. The support layer 820 can be formed from a material having flexibility suitable for easily contouring to a user's wrists while maintaining sufficient stiffness to maintain support of the watch 800 when attached to the wrist of user. The tensioning element 850 can be coupled to the support layer 820 by a buffer layer 830 that facilitates secure coupling and flexion between the support layer 820 and the tensioning element 850.

Figure 15:
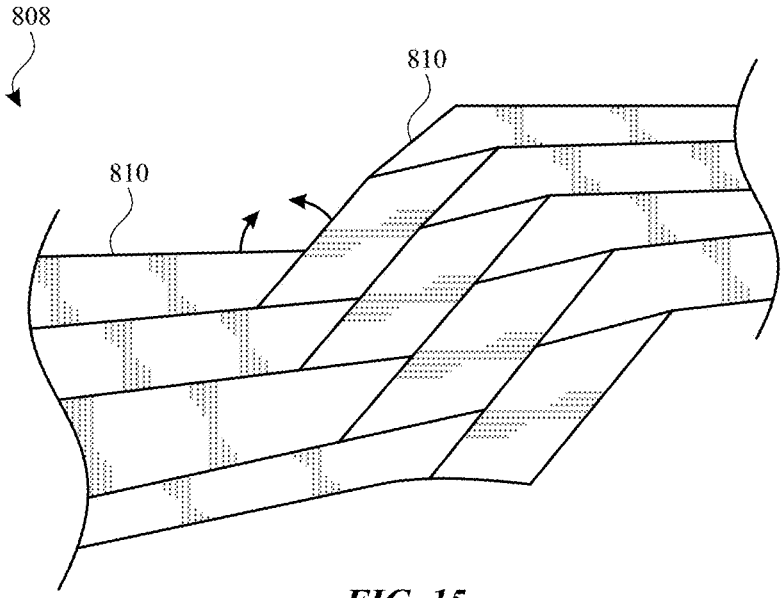
FIG. 15 illustrates a perspective view of a watch band of a watch, according to some embodiments of the present disclosure.

Some or all of the tensioning elements can respond to a stimulus and adjust a fit of the band. For example, the tensioning element 850 can have a deployed configuration. In the deployed configuration, portions of the tensioning element 850 can extend away from each other. By further example, as shown in FIG. 15, the tensioning element 850 can have a folded configuration. In the folded configuration, the tensioning element 850 forms folds 810 and moves portions of thereof toward each other to change a feature of the band 808. As such, the induced change along the length of the tensioning element 850 can create a tighter fit on the wrist of the user. While one example of a folded configuration is illustrated, it will be understood that a variety folds can be made. The band 808 can form undulating patterns, corrugation, bellows, origami shapes, and the like. Folding patterns can be selected based on desired softness and gripping capabilities of the band.

The tensioning element 850 can include one or more shape memory polymers that respond to a stimulus, such as heat. For example, the user and/or the watch can apply a stimulus, such as heat and/or an induced temperature or temperature change to the tensioning element 850. Such a stimulus can be applied passively, such as when the band 808 is worn by a user, when the user raises the user's own body temperature, and/or when a user increases an amount of heat emitted. Additionally or alternatively, a stimulus can be actively applied, such as by a tensioner operated at the housing 804 of the watch 800 to emit heat and/or induce a temperature or temperature change in the tensioning element 850. In response, the shape memory polymer of the tensioning element 850 can provide an ability to reversibly change the fit of the watch band by changing a characteristic of the tensioning element 850. For example, the tensioning element 850 can change to adjust a length of the band 808 in a manner similar to the change illustrated in FIG. 2. By further example, the tensioning element 850 can change to adjust a shape of the band 808 in a manner similar to the change illustrated in FIG. 3. By further example, the tensioning element 850 can change to adjust a thickness of the band 808 in a manner similar to the change illustrated in FIG. 4. Other components of the band 808 (e.g., the buffer layer 830 and/or the support layer 820) can adjust to match or otherwise accommodate the change in the tensioning element 850. Accordingly, the tensioning element 850 can respond to a stimulus to adjust a fit of the band 808 on a wrist of the user.

In the embodiments disclosed herein, a shape memory polymer can be provided to respond to a stimulus. In some embodiments, the shape memory polymer is a Tm-type shape memory polymer with a crystalline switching segment. In some embodiments, the shape memory polymer is a Tg-type shape memory polymer with an amorphous switching temperature.

A Tm-type shape memory polymer is characterized by high durability under cyclic stretching, high speed response of shape recovering, and drastic moduli drop by shape recovering. In some embodiments, the drop in moduli can be mitigated by forming a composite polymer. In some embodiments, the molecular structure can be controlled to realize controllable stress induced crystallization, which is introduced at limited strain range under stretching. Accordingly, a band of a Tm-type shape memory polymer can be provided with characteristics to cover the wide range of wrist sizes and shapes. In addition to a fastening force (as shown in FIG. 2), such a band can apply both coiling force (as shown in FIG. 3) and pressure (as shown in FIG. 4) to realize a suitable fit by using both Tg- and Tm-type shape memory polymers.

Figure 16:
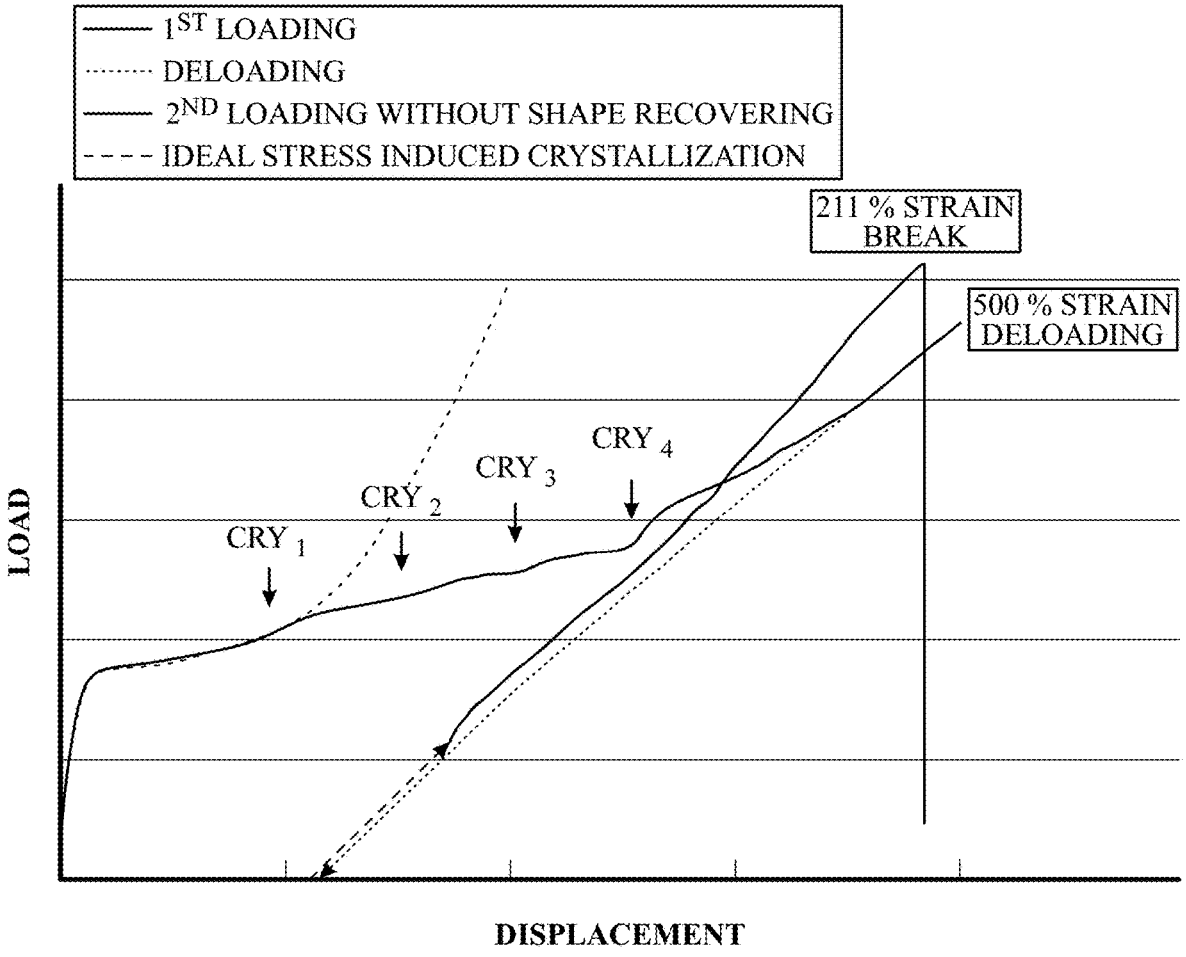
FIG. 16 illustrates a graph showing a comparison of watch band displacements for given loads, according to some embodiments of the present disclosure.

A Tm-type shape memory polymer (e.g., Poly ε-caprolactone) has shown stress-induced crystallization under stretching. FIG. 16 shows PCL-SMP tensile load-displacement curve up to about 5 times elongation. The first loading of the load-displacement curve shows discontinuous jump-up points under the plastic strain region, which is recognized as conventional stress-induced crystallization. After deloading, reloading is achieved without shape recovering, which shows a large tangential value to compare with the first loading. Notably, there is no discontinuous jump-up point, which indicates stress-induced crystallization in PCL-SMP, which breaks with a higher load than the first loading. By controlling the molecular structure to unify the strain value for initiation of stress-induced crystallization, an ideal load-displacement curve can be achieved for a desired fit of a band.

Figure 17:
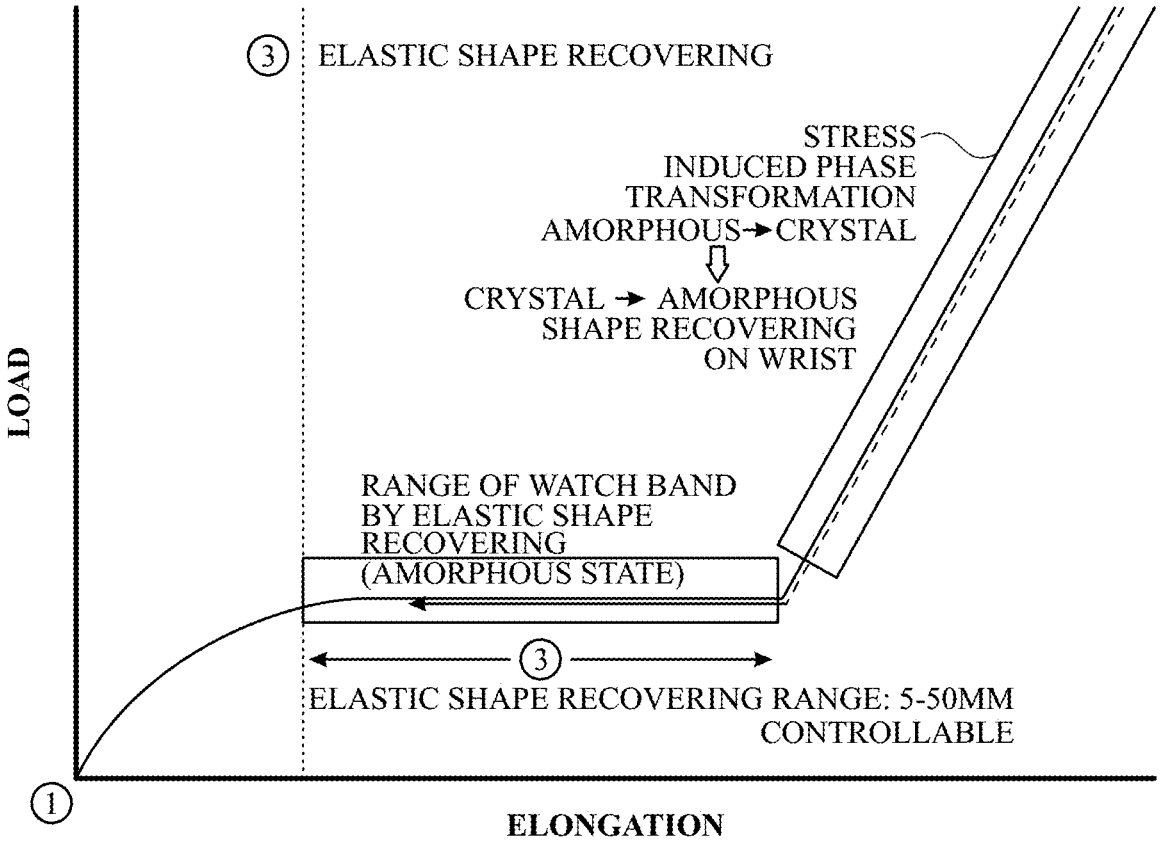
FIG. 17 illustrates a graph showing a comparison of watch band elongation for given loads, according to some embodiments of the present disclosure.

FIG. 17 shows a graph with an ideal load-displacement curve for a band. The shape of the load-displacement curve is similar to the line in FIG. 16. The required elongation to allow a user to don a band (e.g., over the hand) is about 100% (e.g., double the band length). An adjustable range of band length for individual persons is about 50 mm with almost constant fastening load about from 1N to 2N, this might be possible to design the PCL-SMP.

In order to eliminate the moduli drop by shape recovering of Tm-type shape memory polymers, a composite shape memory polymer can be provided. For example, a composite shape memory polymer can include a blend of a Tm-type shape memory polymer and a Tg-type shape memory polymer.

Figure 18:
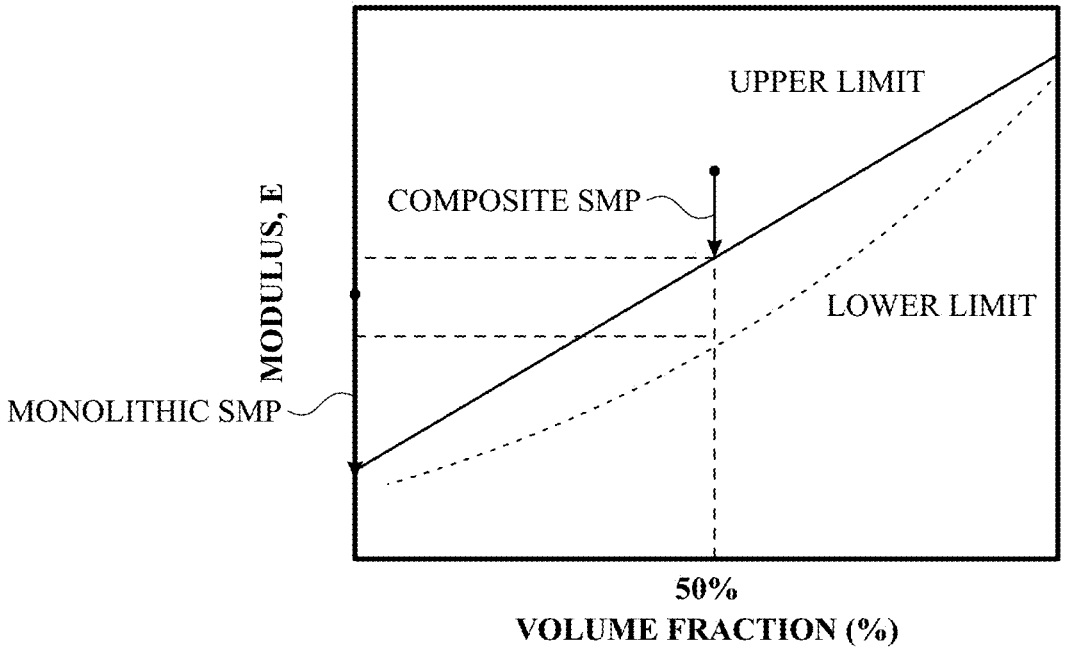
FIG. 18 illustrates a graph showing a comparison of watch band volume fractions for given elasticities, according to some embodiments of the present disclosure.

FIG. 18 shows data from an example of a shape memory polymer composite that avoids significant moduli drop by shape recovering. One or more of a variety of shape reinforcing materials can be included in a composite shape memory polymer. As shown in FIG. 18, a monolithic shape memory polymer is compared to a composite shape memory polymer. A significant difference is demonstrated in the moduli drop between a monolithic Tm-type SMP and a composite Tm-type shape memory polymer. With the combination of 50% volume fraction of 20 MPa moduli particles, the moduli drop is about 10/14. Thus, the moduli decreases down to 71% (i.e., 29% lost). In contrast, that of the monolithic Tm-type shape memory polymer is about 1/16, so the moduli decrease down to 6% (i.e., 94% lost) immediately. Accordingly, by using a composite shape memory polymer, significant moduli drop can be avoided.

Accordingly, watch bands described herein can be provided with an ability to dynamically adjust the fit of a watch against a wrist of a user. One or more of a variety of tensioning elements can be provided with a shape memory polymer that responds to a stimulus to adjust a fit of the band. Such stimulus can be from user or actively applied by the watch. The shape memory polymer can be a composite material that provides high durability under cyclic stretching and high speed response of shape recovering while avoiding a drastic moduli drop by shape recovering Various examples of aspects of the disclosure are described below as clauses for convenience. These are provided as examples, and do not limit the subject technology.

Clause A: a watch band comprising: warp strands formed by tensioning elements comprising shape memory polymer; and weft strands interwoven with the warp strands, wherein the warp strands are configured to adjust a fit of the watch band in response to an induced temperature.

Clause B: a watch band comprising: a cover defining ends configured to engage a housing of a watch; a tensioning element between the ends of the cover, the tensioning element comprising a shape memory polymer and being configured to transition, based on an induced temperature, between: a first configuration in which the tensioning element is substantially straight; and a second configuration in which the tensioning element is substantially serpentine.

Clause C: A watch band comprising: a watch engagement element configured to engage a housing of a watch; tensioning elements each comprising multiple tensioning layers extending away from the watch engagement element, each one of the tensioning layers extending a different distance from the watch engagement element, the tensioning layers comprising one or more shape memory polymers.

One or more of the above clauses can include one or more of the features described below. It is noted that any of the following clauses may be combined in any combination with each other, and placed into a respective independent clause, e.g., clause A, B, or C.

Clause 1: the warp strands are inner warp strands; and the watch band further comprises: a first outer warp strand; and a second outer warp strand opposite the first outer warp strand, wherein the inner warp strands are between the first outer warp strand and the second outer warp strand.

Clause 2: the tensioning elements are configured to adjust a fit of the watch band in response to heat emitted from a wrist of a user when the watch band is worn on the wrist.

Clause 3: the tensioning elements are configured to respond to a stimulus to adjust a fastening force of the watch band on a wrist of a user.

Clause 4: the tensioning elements are configured to respond to a stimulus to adjust a coiling force of the watch band on a wrist of a user.

Clause 5: the tensioning elements are configured to respond to a stimulus to adjust a pressure of the watch band on a wrist of a user.

Clause 6: the tensioning element is a first tensioning element; and the watch band further comprises a second tensioning element that, while in the first configuration, is parallel to the first tensioning element.

Clause 7: the tensioning element is configured to adjust a fit of the watch band in response to heat emitted from a wrist of a user when the watch band is worn on the wrist.

Clause 8: the watch band defined an inner surface and an outer surface, wherein a shortest one of the tensioning layers is closer to the outer surface than any other one of the tensioning layers, and a longest one of the tensioning layers is closer to the inner surface than is any other one of the tensioning layers.

Clause 9: each of the tensioning elements are configured to transition between: a first configuration in which the tensioning elements are a first distance away from each other; and a second configuration in which the tensioning elements are a second distance away from each other.

Clause 10: at least two of the tensioning layers have different thicknesses.

Clause 11: at least two of the tensioning layers have different widths.

Clause 12: the tensioning elements are configured to adjust a fit of the watch band in response to heat emitted from a wrist of a user when the watch band is worn on the wrist.

Clause 13: the tensioning elements are configured to respond to a stimulus to adjust at least one of a fastening force, a coiling force, and a pressure of the watch band on a wrist of a user.

Clause 14: the one or more shape memory polymers is a composite comprising a Tm-type shape memory polymer and a Tg-type shape memory polymer.

As described above, one aspect of the present technology may include the gathering and use of data available from various sources. The present disclosure contemplates that in some instances, this gathered data may include personal information data that uniquely identifies or can be used to contact or locate a specific person. Such personal information data can include demographic data, location-based data, telephone numbers, email addresses, twitter ID's, home addresses, data or records relating to a user's health or level of fitness (e.g., vital signs measurements, medication information, exercise information), date of birth, or any other identifying or personal information.

The present disclosure recognizes that the use of such personal information data, in the present technology, can be used to the benefit of users. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the US, collection of or access to certain health data may be governed by federal and/or state laws, such as the Health Insurance Portability and Accountability Act (HIPAA); whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of advertisement delivery services, the present technology can be configured to allow users to select to "opt in" or "opt out" of participation in the collection of personal information data during registration for services or anytime thereafter. In another example, users can select not to provide mood-associated data for targeted content delivery services. In yet another example, users can select to limit the length of time mood-associated data is maintained or entirely prohibit the development of a baseline mood profile. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, content can be selected and delivered to users by inferring preferences based on non-personal information data or a bare minimum amount of personal information, such as the content being requested by the device associated with a user, other non-personal information available to the content delivery services, or publicly available information.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A watch band comprising:

a cover defining ends configured to engage a housing of a watch;

a tensioning element between the ends of the cover, the tensioning element comprising a shape memory polymer and being configured to transition, based on an induced temperature, between:

a first configuration in which the tensioning element is substantially straight; and a second configuration in which the tensioning element is substantially serpentine.

2. The watch band of claim 1, wherein:

the tensioning element is a first tensioning element; and the watch band further comprises a second tensioning element that, while in the first configuration, is parallel to the first tensioning element.

3. The watch band of claim 1, wherein the tensioning element is configured to adjust a fit of the watch band in response to heat emitted from a wrist of a user when the watch band is worn on the wrist.

4. The watch band of claim 1, wherein the tensioning element is configured to respond to a stimulus to adjust at least one of a fastening force, a coiling force, and a pressure of the watch band on a wrist of a user.

5. The watch band of claim 1, wherein the shape memory polymer is a composite comprising a Tm-type shape memory polymer and a Tg-type shape memory polymer.

6. A watch band comprising:

a watch engagement element configured to engage a housing of a watch; and tensioning elements each comprising multiple tensioning layers overlapping each other and extending from the watch engagement element, each one of the tensioning layers extending a different distance from the watch engagement element, the tensioning layers comprising one or more shape memory polymers.

7. The watch band of claim 6, wherein the watch band defined an inner surface and an outer surface, wherein a shortest one of the tensioning layers is closer to the outer surface than any other one of the tensioning layers, and a longest one of the tensioning layers is closer to the inner surface than is any other one of the tensioning layers.

8. The watch band of claim 6, wherein each of the tensioning elements are configured to transition between:

a first configuration in which the tensioning elements are a first distance away from each other; and a second configuration in which the tensioning elements are a second distance away from each other.

9. The watch band of claim 6, wherein at least two of the tensioning layers have different thicknesses.

10. The watch band of claim 6, wherein at least two of the tensioning layers have different widths.

11. The watch band of claim 6, wherein the tensioning elements are configured to adjust a fit of the watch band in response to heat emitted from a wrist of a user when the watch band is worn on the wrist.

12. The watch band of claim 6, wherein the tensioning elements are configured to respond to a stimulus to adjust at least one of a fastening force, a coiling force, and a pressure of the watch band on a wrist of a user.

13. The watch band of claim 6, wherein the one or more shape memory polymers is a composite comprising a Tm-type shape memory polymer and a Tg-type shape memory polymer.

14. A watch band comprising:

a watch engagement element configured to engage a housing of a watch;

a first tensioning layer connected to and extending from the watch engagement element, the first tensioning layer having a first terminal end that is a first distance away from the watch engagement element;

a second tensioning layer connected to and extending from the watch engagement element, the second tensioning layer having a second terminal end that is a second distance, greater than the first distance, away from the watch engagement element; and a third tensioning layer connected to and extending from the watch engagement element, the third tensioning layer having a third terminal end that is a third distance, greater than the second distance, away from the watch engagement element.

15. The watch band of claim 14, wherein the watch band defined an inner surface and an outer surface, wherein the first tensioning layer is closer to the outer surface than are the second tensioning layer and the third tensioning layer, and the third tensioning layer is closer to the inner surface than are the first tensioning layer and the second tensioning layer.

16. The watch band of claim 14, wherein at least two of the first tensioning layer, the second tensioning layer, and the third tensioning layer have different thicknesses.

17. The watch band of claim 14, wherein at least two of the first tensioning layer, the second tensioning layer, and the third tensioning layer have different widths.

18. The watch band of claim 14, wherein the first tensioning layer, the second tensioning layer, and the third tensioning layer are configured to adjust a fit of the watch band in response to heat emitted from a wrist of a user when the watch band is worn on the wrist.

19. The watch band of claim 14, wherein the first tensioning layer, the second tensioning layer, and the third tensioning layer are configured to respond to a stimulus to adjust at least one of a fastening force, a coiling force, and a pressure of the watch band on a wrist of a user.

20. The watch band of claim 14, each of the first tensioning layer, the second tensioning layer, and the third tensioning layer comprises a composite of a Tm-type shape memory polymer and a Tg-type shape memory polymer.

* * * * *